US006785479B2

(12) United States Patent
Naito et al.

(10) Patent No.: US 6,785,479 B2
(45) Date of Patent: Aug. 31, 2004

(54) IMAGE FORMING APPARATUS HAVING A CONTROL SECTION FOR DETECTING AN AMOUNT OF DEVELOPER AND AN AMOUNT DETECTION METHOD OF DEVELOPER OF IMAGE FORMING APPARATUS

(75) Inventors: Norihito Naito, Shizuoka (JP); Takashi Hibi, Shizuoka (JP); Hideki Matsumoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/314,282

(22) Filed: Dec. 9, 2002

(65) Prior Publication Data

US 2003/0123888 A1 Jul. 3, 2003

(30) Foreign Application Priority Data

Dec. 28, 2001 (JP) ..... 2001-401711

(51) Int. Cl.[7] ..... G03G 15/08
(52) U.S. Cl. ..... 399/27; 399/45; 399/396
(58) Field of Search ..... 399/27, 45, 53, 399/61, 82, 85, 388, 389, 396

(56) References Cited

U.S. PATENT DOCUMENTS

| | | | | |
|---|---|---|---|---|
| 5,835,818 | A | 11/1998 | Hoshika et al. | 399/26 |
| 6,253,036 | B1 | 6/2001 | Karakama et al. | 399/27 |
| 6,330,402 | B1 | 12/2001 | Sakurai et al. | 399/12 |
| 6,343,193 | B1 | 1/2002 | Matsumoto et al. | 399/27 |
| 6,397,017 | B1 | 5/2002 | Sakai et al. | 399/27 |
| 6,397,018 | B1 | 5/2002 | Matsumoto et al. | 399/27 |
| 6,397,019 | B1 * | 5/2002 | Kasuga | 399/27 |
| 6,408,143 | B2 | 6/2002 | Sakurai et al. | 399/27 |
| 6,463,223 | B1 | 10/2002 | Karakama et al. | 399/27 |
| 6,463,225 | B1 | 10/2002 | Abe et al. | 399/27 |
| 6,477,336 | B2 | 11/2002 | Hibi | 399/27 |
| 2002/0009303 | A1 | 1/2002 | Matsumoto et al. | 399/27 |
| 2002/0012542 | A1 | 1/2002 | Karakama et al. | 399/27 |
| 2002/0021908 | A1 | 2/2002 | Matsumoto et al. | 399/27 |
| 2002/0025174 | A1 | 2/2002 | Sakurai et al. | 399/13 |
| 2002/0048463 | A1 | 4/2002 | Otomo et al. | 399/27 |
| 2002/0057918 | A1 | 5/2002 | Kojima et al. | 399/27 |
| 2002/0127024 | A1 | 9/2002 | Matsumoto et al. | 399/27 |

* cited by examiner

*Primary Examiner*—William J. Royer
(74) *Attorney, Agent, or Firm*—Fitzpatrick, Cella, Harper & Scinto

(57) ABSTRACT

The image forming apparatus of the present invention having a developer containing section and a developer remaining amount detecting member, and capable of forming an image at any of a plurality of printing speeds, has a configuration in which the averaging method of the developer remaining amount by the developer remaining amount detecting member is changed in response to the printing speed. The invention thus provides an image forming apparatus having a plurality of printing speeds, which permits successive detection of the remaining amount of developer at a high accuracy in response to the printing speed.

15 Claims, 13 Drawing Sheets

IMAGE FORMING APPARATUS HAVING A CONTROL SECTION FOR DETECTING AN AMOUNT OF DEVELOPER AND AN AMOUNT DETECTION METHOD OF DEVELOPER OF IMAGE FORMING APPARATUS

BACKGROUND OF THE INVENTION

1. Field of the Invention

The present invention generally relates to an image forming apparatus of an electrophotographic type or an electrostatic recording type. More particularly, the invention is suitably applicable to an image forming apparatus in which a cartridge, i.e., a process cartridge or a developing unit in the form of a cartridge, can be detachably mounted on the main body of the image forming apparatus, and which has a developer remaining amount detecting member for successively detecting the remaining amount of a developer in a developer container.

Applicable electrophotographic type image forming apparatuses include an electrophotographic copying machine, an electrophotographic printer (such as an LED printer or a laser beam printer), an electrophotographic facsimile machine, and an electrophotographic wordprocessor. The term "a cartridge detachably attached to the main body of an electrophotographic image forming apparatus" as used herein means a cartridge formed from at least one of an electrophotographic photosensitive member, charging means which charges an electrophotographic photosensitive member, a developing member which supplies a developer to an electrophotographic photosensitive member, and cleaning means which cleans an electrophotographic photosensitive member, which is then made easily detachable from the main body of the electrophotographic image forming apparatus. In particular, the process cartridge is a cartridge composed of at least one of charging means serving as process means acting on an electrophotographic photosensitive member and the electrophotographic photosensitive member are integrally formed into a cartridge, and is made detachable from the main body of the electrophotographic image forming apparatus.

2. Description of the Related Art

In a conventional image forming apparatus, such as a copying machine or a laser beam printer of the electrophotographic type, an electrostatic latent image is formed by irradiating light (laser beam or the like) in accordance with image information onto an electrophotographic photosensitive member (hereinafter simply referred to as a "photosensitive member"). The thus formed electrostatic latent image is made visible into a developer image (toner image) by supplying a developer (toner) as a recording material to the latent image by developing means, and an image is formed on a recording medium, such as recording paper from the photosensitive member.

A developer container serving as a developer containing vessel is connected to the developing means, where developer is consumed by forming an image. The developer container, the photosensitive member and the charging means are often formed integrally as a process cartridge detachably mounted on the main body of the image forming apparatus (hereinafter simply referred to as the "apparatus main body"). When the developer is exhausted, for example, the user can form again an image by replacing this process cartridge. This is a developing unit having the developing means and the developer container formed into a cartridge detachably mounted individually on the apparatus main body. In particular, according to the process cartridge process, it is possible to apply the developer, and at the same time, replace other supplies, such as the photosensitive member, by replacing the process cartridge relative to the apparatus main body, thereby permitting a remarkable improvement of maintainability of the apparatus.

For example, for the purpose of knowing from time to time the remaining amount of the developer usable for forming an image in the process cartridge, a process cartridge or an apparatus main body having a developer remaining amount detecting member capable of successively detecting the developer remaining amount level is becoming more popular.

Available means for achieving detection of the developer remaining amount level include a method of measuring the amount of developer through a change in capacitance by means of a capacitor-type bipolar electrode (conductive section), and a method of measuring the amount of developer from a difference between the amount of transmitted light and the amount of received light, produced by emitting light into the developer container.

A detecting method based on a so-called plate antenna, in which a capacitor-type bipolar electrode is arranged, will now be described as an example of the developer remaining amount detecting member. The plate antenna has a pair of electrodes (conductive section) arranged substantially in parallel with each other spaced apart by a prescribed distance. This electrode pair is arranged, for example, in or outside the process cartridge so as to cover the toner in the developer container. That is, this is based on the fact that the capacitance varies with the amount of developer between the electrode pair. This makes it possible to establish a correlation between the amount of developer in the developer container and the capacitance between the electrode pair. It is therefore possible to know at any time the remaining amount level of developer in the developer container by measuring the capacitance by means of the plate antenna. The capacitance of the plate antenna from the current value is generated in one of the electrode pair by impressing an AC bias onto the other.

However, the above-mentioned conventional detecting method of the developer remaining amount level, i.e., the method of measuring the amount of developer from a change in capacitance between two electrode poles may sometimes cause the following problems.

In the conventional method, the capacitance varies with the area of the plate antenna provided in the developer container covered by the developer. A developer remaining amount level is calculated in response to this change, and the result of calculation is notified to the user.

For more recent image forming apparatuses, however, the frequency of use of a laser beam printer is only increasing, and the print volume is also increasing. Furthermore, there is a demand for increasing the printing speed of the apparatus main body (hereinafter referred to as a "throughput") for improving usability and reducing the output time.

Measures taken so far for increasing the throughput include replacement of the driving motor by one with a higher rotating speed, and reduction of the distance between two recording sheets conveyed when continuously outputting images, known as the paper distance.

Because an increase in the absolute amount of heat results from rotation and fixing along with an increase in throughput, temperature increase and similar problems tend to occur. In order to obtain a high-quality output image, it is necessary to increase the fixing temperature. Particularly, when conveying a small-sized recording medium with a narrow width, such as an envelope and a postcard (hereinafter referred to as the "paper feed"), an abnormal temperature is observed at portions not feeding the paper.

An increasing number of apparatuses have now diversified throughput to cope with higher-accuracy printing (high-resolution image), including provision of a plurality of modes, such as a half-speed mode or high-accuracy printing mode at a very low speed.

The increase in throughput also has an effect on the state of the developer in the developer container. An example is the calculation of the developer in the developer container caused by a stirring unit. When the rotating speed of the driving motor is increased so as to increase the throughput, rotation of the stirring unit provided in the developer container also increases. As a result, the developer in the developer container is actively stirred.

The increase in throughput leads to a considerably reduced acquired data by the developer remaining amount detecting member relative to the image output to a recording sheet. If data are processed for detecting the remaining amount level of the developer with the thus reduced acquired data, the influence of developer circulation in the developer container section caused by stirring by the stirring unit is serious, and the accuracy of detection of the remaining amount level of developer may be deteriorated.

Detection of the developer remaining level has conventionally been conducted, particularly, for the proximity of the developer carrier (in the developer container holding the developer carrier) from the change in capacitance between the developer carrier conveying the developer to the photosensitive member and a conductive plate provided near the pole thereof. In this conventional practice, the capacitance produced between the developer carrier and the plate is measured by use of a developing bias applied/impressed onto the developer carrier.

It is however necessary to measure, not only in the proximity of the developer carrier, but also to measure the developer remaining amount level in the developer container connected to the developing means, because of the increase in the developer loadage of the process cartridge. The amount of developer in the developer container is commonly measured by impressing a bias for detecting the developer remaining amount level onto the plate antenna provided in the developer container in a bias circuit different from the developing bias. In this case, if the bias for detecting the developer remaining amount level is impressed onto the plate antenna simultaneously with the developing bias, it is difficult to accurately detect the developer remaining amount level under the effect of the developing bias. Therefore, the developer amount is measured by impressing the bias for detecting the developer remaining amount level onto the plate antenna immediately before feeding the recording sheets or between recording sheets during continuous paper feeding when the developing bias is not impressed onto the developer carrier. This further reduces the number of acquired data for detecting the developer remaining amount level along with the increase in throughput.

There is also adopted a method of changing the number of revolutions of the driving unit so as to change the throughput. However, a change in the number of revolutions of the driving unit results in large changes in the number of revolutions of the stirring unit, and in circulation of the toner itself in the toner container. In a special mode, in which the number of revolutions of the driving unit is increased for high-resolution output, a problem is encountered in that it becomes impossible to accomplish detection of the toner remaining amount. It is thus difficult to simultaneously satisfy requirements for accurately detecting the developer remaining amount level, on the one hand, and improving throughput with a configuration having a plurality of throughput modes, on the other hand.

In view of the aforementioned problems, the present inventors carried out extensive studies, and obtained the following findings. Even when the throughput is increased, and if the throughput is reduced for the purpose of ensuring a high endurance of the apparatus to prevent temperature increase upon feeding, for example, small-sized recording sheets, or using a low-speed mode provided for high-accuracy printing (to achieve a higher quality of images), it is possible to eliminate the effect of swell resulting from a stirring period of the stirring unit by changing the averaging time of measured data of the amount of developer or the number of data used for averaging in response to the throughput, and to improve the detecting accuracy of the developer remaining amount level by increasing data available from a run of paper feeding process as far as possible.

SUMMARY OF THE INVENTION

The present invention was developed to solve the above-mentioned problems, and has an object to provide an image forming apparatus, having a plurality of printing speeds (throughput), which permits successive detection of the remaining amount of developer at a high accuracy in response to the printing speed (throughput).

The present invention provides an image forming apparatus capable of forming an image at any of a plurality of printing speeds, comprising: a developer container containing a developer, a developer amount detecting member which detects a developer remaining amount in the developer container and outputs the detection value; and a control section which detects a developer remaining amount by subjecting a plurality of detection values from the developer amount detecting member to an arithmetic processing to detect the remaining amount of developer; wherein the control section changes the arithmetic processing in response to the printing speed.

The present invention also provides an image forming apparatus capable of forming an image at any of a plurality of printing speeds, comprising: a developer container containing a developer; a developer amount detecting member which detects a developer remaining amount in the developer container and outputs the detection value; a conveying section for conveying a recording medium on which an image is to be formed; and a control section which detects a remaining amount of developer by arithmetically processing a detection value output from the developer amount detecting member for each run of conveyance of the recording medium to the conveying section; wherein the control section changes the detecting period of the detection value from the developer amount detecting member for each run of conveyance of the recording medium to the conveying section, in response to the printing speed.

The present invention provides a controlling method of an image forming apparatus capable of forming an image at any of a plurality of printing speeds, where the image forming apparatus comprises: a developer container containing a developer; a developer amount detecting member which detects a developer remaining amount in the developer container and outputs the detection value; and a control section which detects a developer remaining amount by subjecting a plurality of detection values from the developer amount detecting member to an arithmetic processing to detect the remaining amount of developer; the controlling method comprises: a first step of detecting the kind of a recording medium for forming an image; a second step of determining a printing speed in response to the kind of the recording medium detected in the first step; and a third step of detecting the remaining amount of developer by changing the arithmetic processing in response to the printing speed determined in the second step.

The present invention provides another controlling method of an image forming apparatus capable of forming an image at any of a plurality of printing speeds, where the image forming apparatus comprises: a developer container containing a developer; a developer amount detecting member which detects a developer remaining amount in the developer container and outputs the detection value; a conveying section for conveying a recording medium on which an image is to be formed; and a control section which detects a remaining amount of developer by arithmetically processing a detection value output from the developer amount detecting member for each conveyance of a recording medium to the conveying section, the controlling method comprises: a first step of determining a printing speed in response to the image forming mode of the image forming apparatus; a second step of changing the detection period of a detection value from the developer amount detecting member for every conveyance of a recording medium to the conveyance section in response to the image forming mode determined in the first step; and a third step of detecting a remaining amount of developer using a detection value detected in the second step.

Further objects, features and advantages of the present invention will become apparent from the following description of the preferred embodiments (with reference to the attached drawings).

DESCRIPTION OF THE PREFERRED EMBODIMENTS

The image forming apparatus of the present invention will now be described in detail with reference to the drawings.

First Embodiment

Figure 1:
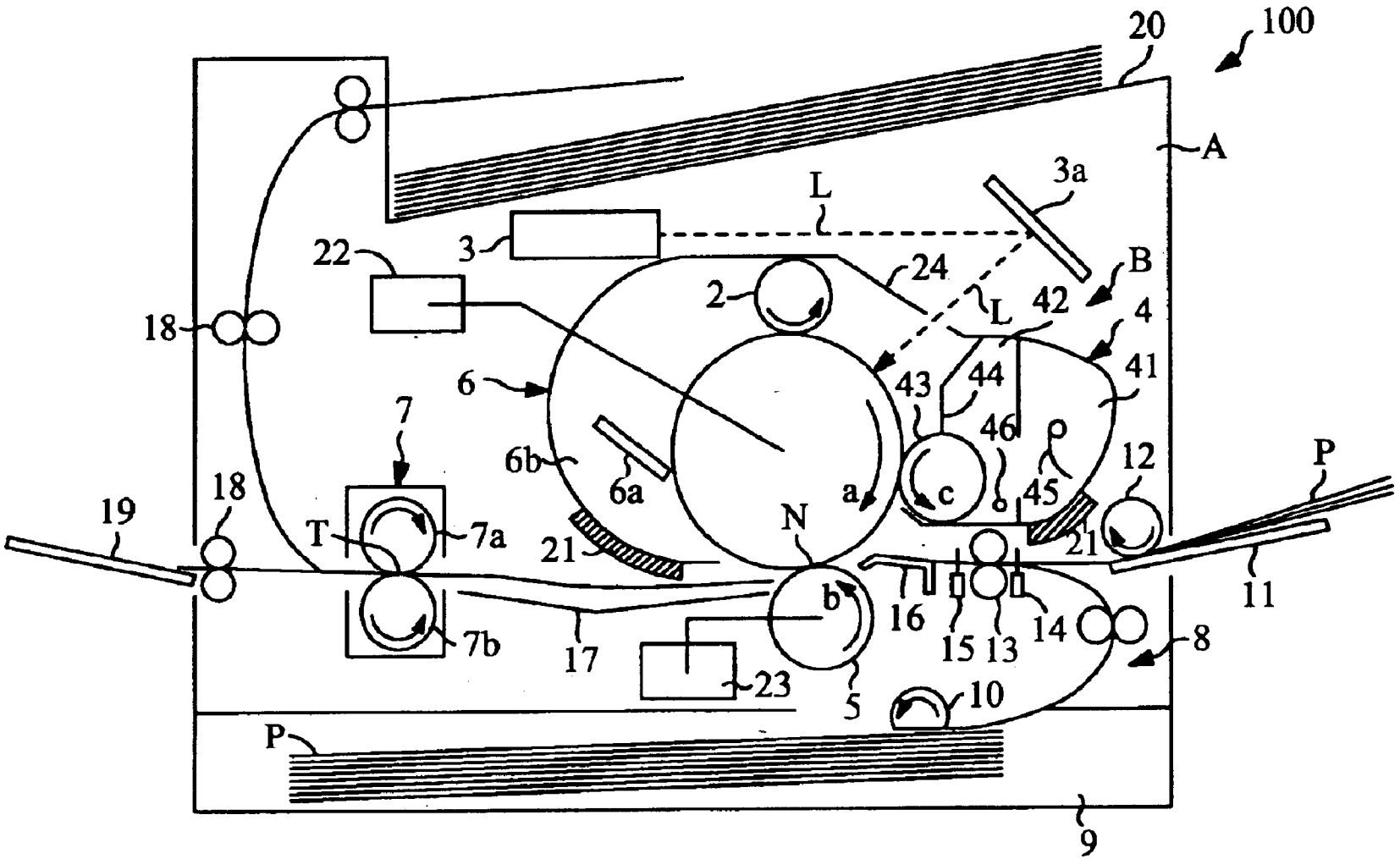
FIG. 1 is a schematic configuration diagram of an embodiment of the image forming apparatus of the present invention.

FIG. 1 illustrates a schematic sectional view of an embodiment of the image forming apparatus of the present invention. The image forming apparatus 100 of this embodiment is a laser printer which receives image information from an external host, such as a personal computer connected to the apparatus main body to permit communication, and outputs the same in the form of an electrophotographically visualized image. In the image forming apparatus 100 of this embodiment, supplies such as an electrophotographic photosensitive member, the developing means and the developer can be replaced by attaching and detaching the process cartridge to and from the apparatus main body A.

The image forming apparatus 100 has an electrophotographic photosensitive member of the image carrier drum type, i.e., a photosensitive drum 1. The photosensitive drum 1 is built by depositing a photosensitive material, such as OPC or amorphous Si, onto a cylinder-type substrate, and is rotation-driven at a prescribed circumferential speed in an arrow "a" direction (clockwise) in FIG. 1 by driving means 22. Charging means 2, which uniformly charges the circumferential surface of the rotating photosensitive drum 1, is provided around the photosensitive drum 1. In this embodiment, a contact charger (charging roller) 2 which performs charging in contact with the circumferential surface of the photosensitive drum 1 is employed as charging means.

A laser beam scanner 3, 3*a*, serving as image information exposure means, is provided in the image forming apparatus 100. The laser beam scanner 3, 3*a* includes a semiconductor laser, a polygon mirror, and an F-q lens. The laser beam scanner 3, 3*a* emits a laser beam L ON/OFF-controlled in response to image information sent from a host (not shown) connected to the apparatus main body A so as to permit communications, scans and exposes the uniformly charged surface of the photosensitive drum 1, and forms an electrostatic latent image.

A developing unit 4 is arranged around the photosensitive drum 1, and develops the electrostatic latent image formed on the photosensitive drum 1 into a toner image. Available developing means include the popularly known jumping developing process and the binary developing process, which are often used in combination of the image exposure and reversing phenomenon. In this embodiment, the toner is supplied on the basis of the reversing phenomenon to a portion of the negatively charged photosensitive drum 1 where the negative potential dumps by exposure, by use of a negatively charged insulating magnetic single-ingredient developer (toner).

In the rotating direction "a" of the photosensitive drum 1, a transfer roller 5, serving as transfer means, is provided downstream of the developing unit 4. In this embodiment, the transfer roller 5 is a rotary-member-shaped contact member having an elastic layer, and forms a transfer nip portion N in pressure-contact with the photosensitive drum 1. The transfer roller 5 is rotation-driven at a prescribed circumferential speed in the arrow "b" direction (anti-clockwise) in FIG. 1 by driving means 23. The toner image formed on the photosensitive drum 1 is sequentially electrostatically transferred onto a recording sheet P (transferred medium) supplied from a recording medium supply section 8 to the transfer nip portion N.

The recording sheet supply section 8 has a recording sheet cassette 9, a recording sheet container such as a manual feed tray 11, separation rollers 10 and 12 which separation-feed the recording sheets P, sheet by sheet, a resist roller 13 and a pre-transfer guide 16. A recording sheet P fed from the recording sheet containers 9 and 11, after first waiting for further feeding at a pre-feed sensor 14, passes through the resist roller 13, a resist sensor 15, and the pre-transfer guide 16, and is fed to the transfer nip portion N (image forming section). Feeding of the recording sheet P is synchronized with formation of a toner image on the surface of the photosensitive drum 1 by the resist sensor 15, so that the recording sheet P is fed to the transfer nip portion N. The separation rollers 10 and 12 are provided to solve the problem of erroneous overlapping feed of a plurality of recording sheets P upon feeding of a recording sheet P.

The recording sheet P onto which the toner image has been transferred to the transfer nip portion N and which has passed through the transfer nip portion N is separated from the surface of the photosensitive drum 1, and conveyed through a sheet path 17 to a fixing unit 7. The fixing unit 7 of this embodiment is a film heating type fixing unit comprising a heating film unit 7*a* and a pressure-contact roller pair of pressing rollers 7*b*. The recording sheet P retaining the toner image is held between the heating film unit 7*a* and the fixing nip portion T, which is the pressure-contact portion of the pressing roller 7*b*, heated and pressurized. This fixes the toner image onto the recording sheet P to form a permanent image.

The recording sheet P on which the toner image has been fixed is discharged outside the machine by a paper discharge roller 18 in a face-up state into a lower tray 19 or in a face-down state into an upper tray 20.

The surface of the photosensitive drum 1 after transferring the toner image onto the recording sheet P is, on the other hand, cleaned through removal of transfer-residual toner by a cleaner 6, and repeatedly subjected to image forming. The cleaner 6 of this embodiment is a blade cleaner (serving as cleaning means), and has a cleaning blade 6*a*and a waste toner container 6*b*for containing residual toner removed from the photosensitive drum 1 by the cleaning blade 6*a*.

The process cartridge B will now be described in detail with reference to FIG. 2.

Figure 2:
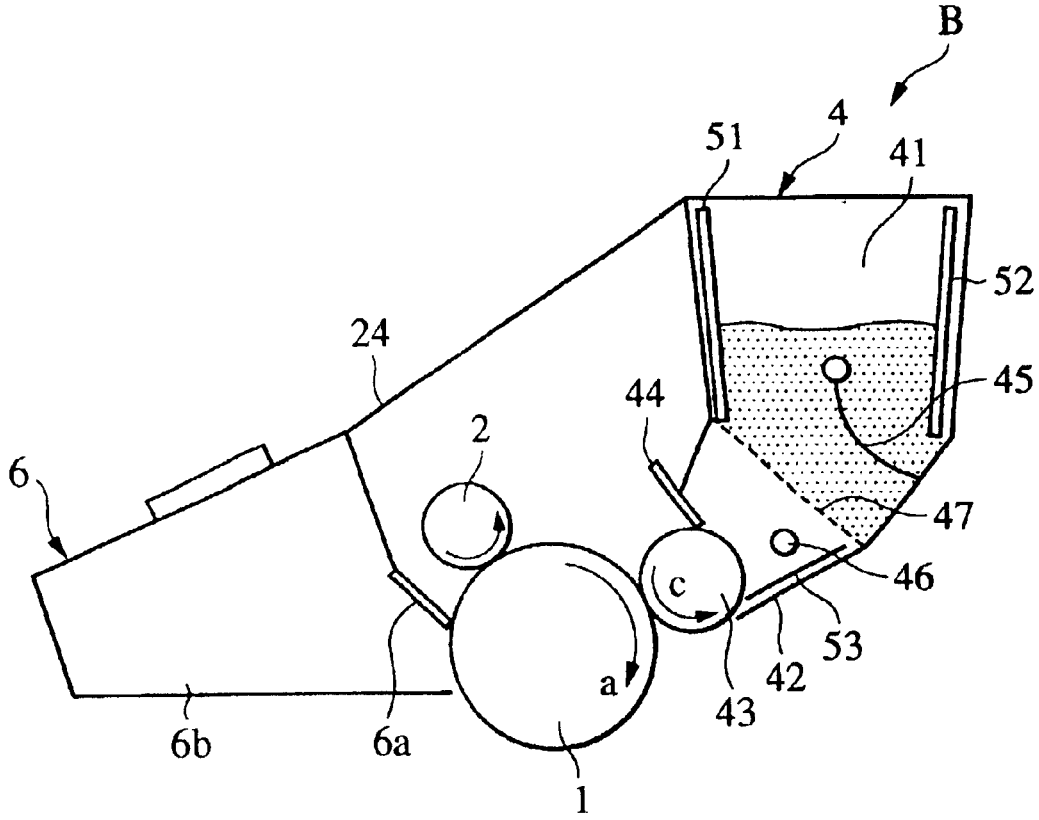
FIG. 2 is a schematic configuration diagram of an embodiment of the process cartridge of the present invention.

As shown in FIG. 2, the process cartridge B comprises a photosensitive drum 1, a charging roller 2, a developing unit 4 and a cleaner 6 integrally configured by a frame 24, and is detachably mounted on the apparatus main body A via attaching means 21 provided on the apparatus main body A (see, FIG. 1).

The developing unit 4 comprises a toner container 41, serving as a developer containing section containing toner, a developing container 42 connected to the toner container 41, a developing roller 43 serving as developing means, arranged opposite the photosensitive drum 1, a developing blade 44 which is in contact with the developing roller 43, and is a developer regulating member regulating the toner layer thickness conveyed by the developing roller 43, a first stirring member 45 which stirs the toner in the toner container 41 and feeds the toner to the developing roller 43, and a second stirring member 46 which conveys the toner fed from the toner container 41 to the developing roller 43. The toner container 41, which is the developer container, and the developing container 42, which is a developing member support, compose the developer container.

Prior to using the process cartridge B, a toner sealing member 47 is affixed between the toner container 41 and the developing container 42. This toner sealing member 47 is provided so as to prevent toner leakage, for example, even when a serious impact occurs during conveyance of the process cartridge B. The toner sealing member 47 is opened by the user immediately before mounting the process cartridge B onto the apparatus main body A.

The developing unit 4 contains the toner serving as a developer in the toner container 41, and sends the toner while stirring the toner by means of the first stirring member 45. The developing container 42 supports the developing roller (developer carrier) 43 which is a non-magnetic sleeve having a built-in fixed magnet roll serving as a magnetic field generator, rotatably in the arrow "c" direction (anti-clockwise) in FIG. 2. The second stirring member 46 feeds the toner sent into the developing container 42 to the developing roller 43. Along with rotation of the developing roller 43, the layer thickness of the toner conveyed on the developing roller 43 is regulated by the developing blade 44, and frictional charge is imparted thereto. As a result of rotation of the developing roller 43, the toner conveyed to the portion opposite the photosensitive drum 1 (developing section) transfers to the photosensitive drum 1 in response to the electrostatic latent image formed on the photosensitive drum 1 by the developing bias impressed onto the developing roller 43 during developing. In this embodiment, a developing bias generated by superimposing an AC voltage and a DC voltage is impressed from developing bias impressing means which is a bias impressing circuit onto the developing roller 43.

As shown in FIG. 1, in this embodiment, a laser beam scanner 3, 3*a* is provided above the process cartridge B in the apparatus main body A in a state in which the process cartridge B is mounted on the apparatus main body, and a transfer roller 5 opposite the photosensitive drum 1 is arranged therebelow.

The image forming apparatus 100 of this embodiment has a developer remaining amount detecting member permitting successive detection of the remaining amount of developer along with consumption thereof.

Figure 3:
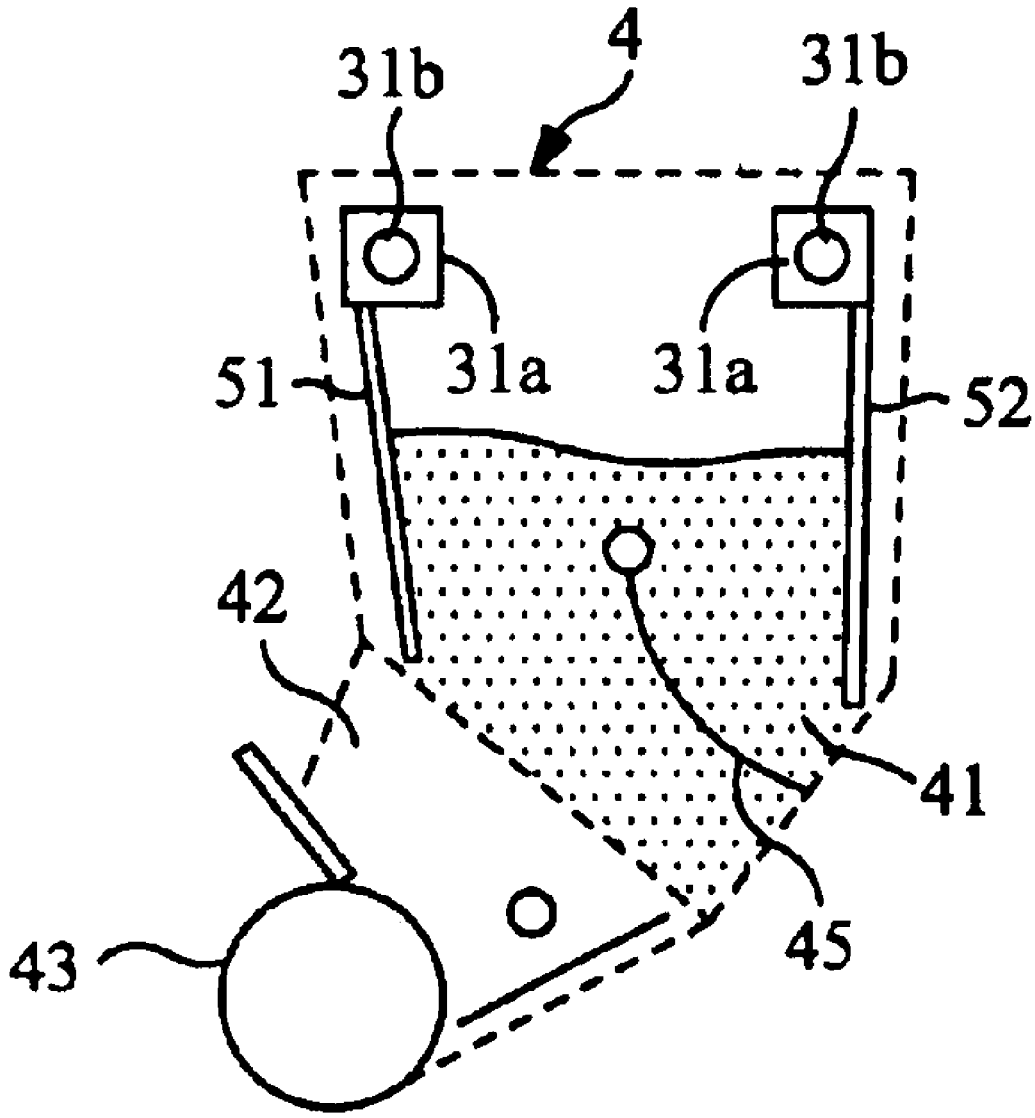
FIG. 3 is a schematic configuration diagram of an embodiment of the developer remaining amount detecting member of the present invention.

Referring to FIG. 3, in this embodiment, a plate antenna, comprising first and second electrodes (conductive plates) 51 and 52, is provided so as to form a capacitor structure within the toner container 41, as a developer remaining amount detecting member, so that the toner is contained in the capacitor formed by these first and second electrodes 51 and 52.

The first and the second electrodes 51 and 52 are installed at positions in the toner container 41 where the toner is fluid and a decrease in the amount of toner can be directly detectable. In this embodiment, the first and the second electrodes 51 and 52 extend in the longitudinal direction (a direction substantially perpendicular to the conveying direction of the recording sheet P) of the developing roller 43. The first electrode 51 is arranged at a position closer to the developing roller 43, and the second electrode 52 is arranged at a position more distant from the developing roller 43.

The material for the first and the second electrodes 51 and 52 suffices to be any conductive plate. When they are installed in the toner container 41, however, the material should preferably be one which does not exert an adverse effect on the toner particles and is resistant to environmental conditions, such as humidity. A portion having a shape conductive from outside should be provided on at least a side of each of the first and second electrodes 51 and 52. This connecting portion may be directly connected by a connecting wire, or may be in the form of a side of the process cartridge skewered by a conductive pin-shaped member. In this embodiment, a pin-shaped conductive member 31*b* picks a lift-up portion 31*a* provided on a side of each of the first and the second electrodes 51 and 52 via the side wall of the process cartridge B in a direction substantially perpendicular to the recording sheet conveying direction. This pin 31*b*is connected to an electric contact (described later) provided outside the process cartridge B so as to be exposed, or formed integrally with such a contact.

The amount of toner is measured by impressing a bias from outside the process cartridge B onto the plate antenna comprising the first and the second electrodes 51 and 52, and measuring the capacitance. For example, an AC current is fed to one of the electrodes, and the voltage value induced on the other electrode is read. The dielectric constant differs with the amount of toner existing between the first and the second electrodes 51 and 52, and the voltage value induced in the electrodes 51 and 52 also differs therewith. The developer remaining amount level is detected by monitoring thus differing voltage values.

Figure 4:
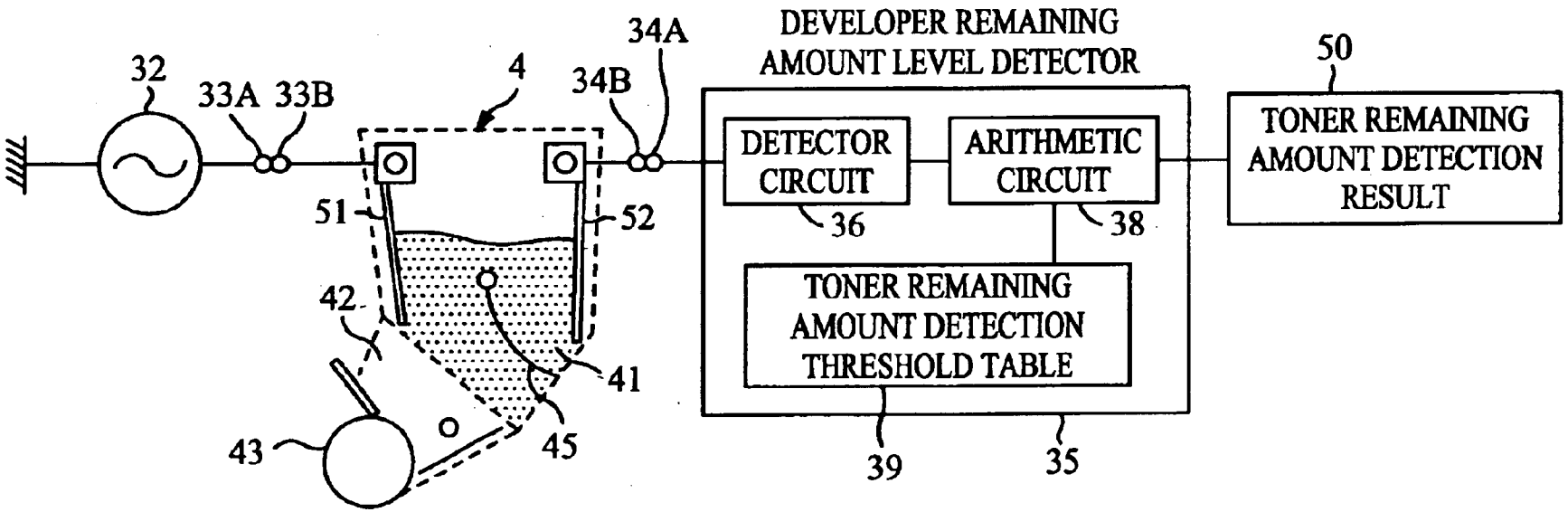
FIG. 4 is a clock diagram for illustrating a schematic circuit configuration of the developer remaining amount level detecting means of the present invention.

FIG. 4 illustrates a circuit configuration of the developer remaining amount level detecting section upon normal mounting of the process cartridge B in the apparatus main body A. Electric contacts are provided on the apparatus main body A and the process cartridge B, respectively. When the process cartridge B is mounted in the apparatus main body A, the first electrode 51 provided in the process cartridge B and the bias impressing circuit 32 for detecting the developer remaining amount level provided in the apparatus main body A are electrically connected through this electric contact. The second electrode 52 provided in the process cartridge B and the developer remaining amount level detecting section 35 are electrically connected.

When a prescribed AC bias is output from the bias impressing circuit 32, serving as bias impressing means, the bias is impressed onto the first electrode 51 in the toner container 41 via the first contact 33A on the apparatus main body side and the first contact 33B on the process cartridge side. Current inducted in the second electrode 52 for the electrostatic capacitance generated in response to the amount of toner between the first and the second electrodes 51 and 52 is output to the developer remaining amount level detecting section 35 of the apparatus main body A via the second contact 34B on the cartridge side and the second contact 34A on the apparatus main body side.

In the developer remaining amount level detecting section 35, the detector circuit 36 detects the entered current value, and sends the measured value, i.e., as a digitized voltage value, to the arithmetic circuit (arithmetic control section) 38, which is control means. The arithmetic control section 38 converts the result of detection of the detector circuit 36 into information for notifying the user of the developer remaining amount level in the form of a percentage of the remaining amount or a number of printable sheets by comparing the result to the remaining amount threshold value table stored in the memory section 39. The remaining amount threshold value table is means for correlating predetermined measured value of capacitance (detected voltage value) with the developer remaining amount level and may take the form of an arithmetic formula.

The arithmetic control section 38 transmits a signal for notifying developer remaining amount level information to informing means, such as a display section 50 of the apparatus main body A, and informs the user of the developer remaining amount level via the informing means. Or, the arithmetic control section 38 transmits a signal for notifying the developer remaining amount level to an external host (not shown) connected to the apparatus, to the apparatus main body A, to permit communications, and can thus notify the user of the same developer remaining amount level information as above via informing means, such as a display unit.

In this embodiment, a bias comprising an AC bias of about 2 kHz, as in the developing bias, and a DC bias of about −400 V superimposed thereon is used for impressing onto the first electrode 51.

The developer remaining amount level detecting method popularly applied at present has a configuration in which the amount of toner in the developing container 42, in which the developing roller 43 and the developing blade 44 are installed, and the amount of toner contained in the toner container 41 are separately detected for the purpose of ensuring a high-accuracy detection of the developer remaining amount level. The usual practice for detecting the amount of toner in the developing container 42 mainly comprises installing the plate antenna near the developing roller 43 so as to form a pair with the developing roller 43 and measuring a change in capacitance between the developing roller 43 and the plate antenna by means of the developing bias impressed onto the developing roller 43.

In the process cartridge B of this embodiment as well, a third electrode 53 is arranged near the developing roller 43 in the developing container 42, and the developer remaining amount level in the developing container 42 is detected as described above. The developer remaining amount level in the process cartridge B is thus detected from the result of detection of the developer remaining amount level in the toner container 41 detected by means of the first and the second electrodes 51 and 52, and the result of detection of the developer remaining amount level in the developing container 42 detected by means of the developing roller 43 and the third electrode 53.

The third electrode 53 may have the same configuration as that of the above-mentioned first and second electrodes 51 and 52. The circuit configuration for detecting the developer remaining amount level in the developing container 42 using the developing roller 43 and the third electrode 53 may be the same as the above-mentioned circuit configuration described above with respect to the first and the second electrodes 51 and 52, except that a developing bias circuit (not shown) is used as a bias impressing circuit. To avoid complexity, therefore, duplicate description thereof is omitted here.

If the amount of toner in the toner container 41 is measured by impressing a bias onto the first electrode 51 simultaneously with the developing bias impressed onto the developing roller 43, on the other hand, the measurement would be affected by the developing bias impressed onto the developing roller 43, thus making it difficult to measure the amount of toner only in the toner container 41.

The bias is therefore impressed onto the first electrode 51 at a timing when the developing bias is not as yet impressed onto the developing roller 43. In this embodiment, measurement of the amount of toner only in the toner container 41 is made possible by impressing an alternating voltage onto the first electrode 51 in the toner container 41 immediately before or after paper feeding, or between a recording sheet P and the next recording sheet P in continuous paper feeding, i.e., between sheets.

However, along with the recent improvement of usability and tendency toward a higher paper feeding speed, the time for pre-feeding preparations or post-feeding ending operations or the time between sheets in continuous paper feeding is reduced, and the time required for detection of the developer remaining amount level tends to be minimized. Furthermore, for the purpose of increasing the number of feedable sheets, there is an increase in the amount of toner loaded in the process cartridge B, and a large-scale circulation is formed by the first stirring member 45 in the toner container 41.

The paper feed timing of the recording sheet P may be made changeable by causing a delay in supply (feeding) of the recording sheet P for the purpose of improving the print quality or maintaining the developing unit 4 or the fixing unit 7, and an image may be formed by altering the paper feed timing in response to the size of the recording sheet P, the state of the developing unit 4 and the state of the fixing unit 7.

It is in general the conventional practice to detect the developer remaining amount level on the basis of averaged data by subjecting a plurality of data acquired within a prescribed period of time by means of the developer remaining amount detecting member to prescribed statistical treatments including averaging (hereinafter referred to as the "averaging processing"). Even through such an averaging processing, there occurs a limit in the developer remaining amount level detecting accuracy for the reasons described above.

In this embodiment, therefore, as described later in detail, the method of averaging processing of data obtained from the developer remaining amount level detecting means is changed in response to the changing time of paper feed timing. In this embodiment, the averaging processing time and the number of averaged data are changed.

Detecting operations of the developer remaining amount level will now be described further in detail. Various detailed setups for the image forming apparatus used for the following study are as follows.

The paper feeding speed is set at 30 ppm, meaning that 30 sheets can be continuously fed per minute. Upon continuously forming images (feeding sheets), sheets are fed at time intervals of about 0.5 seconds, with a startup preparation time from the receipt of a printing instruction to the start of printing of 10 seconds, and a breaking time for the ending processing at the end of printing of 5 seconds. A first stirring member (stirring blade) 45 for stirring the toner is provided in the toner container 41 in which the first and the second electrodes 51 and 52 are installed. Ten revolutions per minute are set so as to achieve a dynamic circulation of toner in the toner container 41. In order to maintain an appropriate rigidity, a PET sheet having a thickness of 0.5 mm is used as the first stirring member 45.

The amount of toner contained in the toner container 41 is set at 1 kg when full. The positions of the first and the second electrodes 51 and 52 are adjusted so as to show 2 pF when the toner container 41 is empty, and to show 6 pF when full of toner. The positions and angles of the first and second electrodes 51 and 52 are finely adjusted so that the decrease in the amount of toner exhibits a linear progress.

At a point in time when the remaining amount of toner in the toner container 41 becomes 50% of capacity, the measured value of the capacitance for the number of fed sheets in the case of one-sheet intermittent feeding is monitored. The measured data (detected voltage value) of the amount of toner at this moment is read by performing a sampling immediately prior to feeding a recording sheet P to achieve a sequence for acquiring data.

Figure 6:
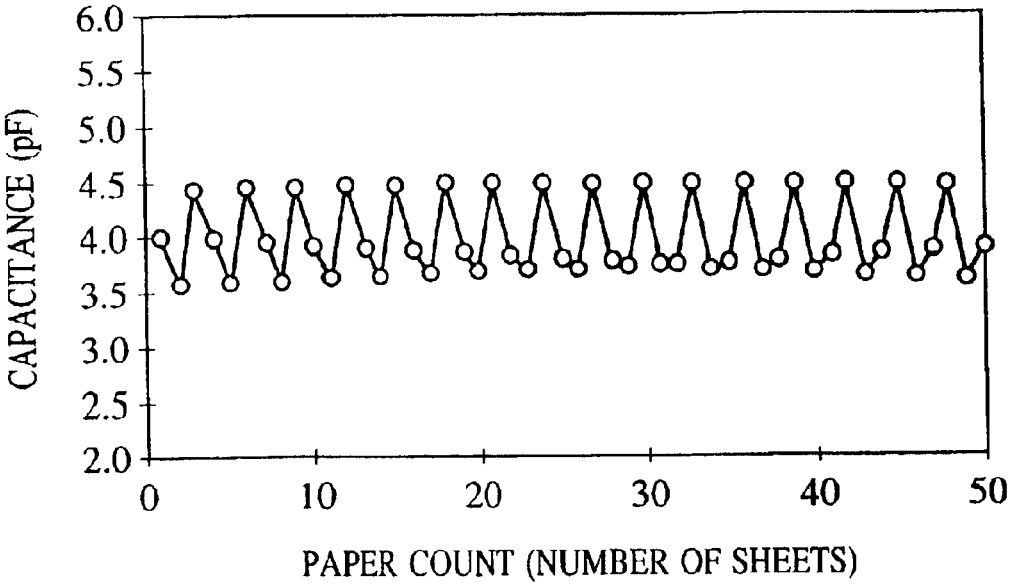
FIG. 6 is a graph illustrating measured data of the toner amount in the first embodiment.

When an averaging is not applied to the measured data, the measured data are as shown in FIG. 6. As is suggested by FIG. 6, occurrence of large swells is observed in response to movement of the first stirring member 45. Since these swells, if left as they are, lead to a very poor detection accuracy of the developer remaining amount level, an averaging processing is applied so as to eliminate swells.

Figure 7:
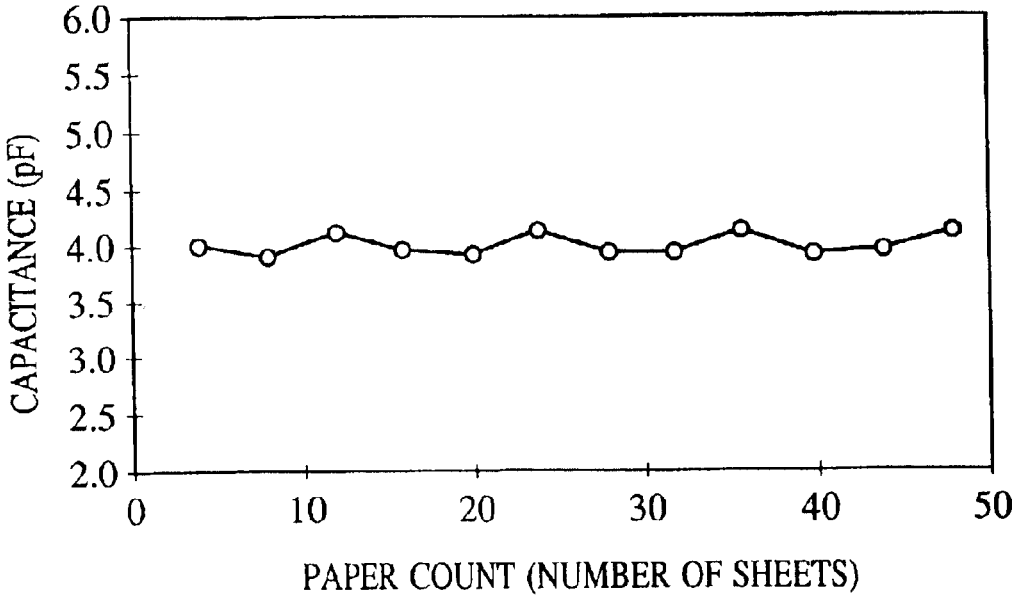
FIG. 7 is a graph illustrating measured data of the toner amount in the first embodiment.

FIG. 7 illustrates the result of the averaging processing applied to the measured data shown in FIG. 6. In this case, averaging is applied to the measured data shown in FIG. 6 after acquisition of four data points. It is suggested that swells are almost completely eliminated by averaging.

A similar observation is made for a case where a change in the paper feed timing occurs as in feeding of a small-sized recording sheet P. For example, when feeding a recording sheet P such as an A5-size or B5-size sheet having a slightly narrower width as compared with a wide recording sheet P such as an A4-sized sheet, the feed timing is assumed to be delayed by two seconds. This is done for the purpose of maintaining the developing unit 4 or the fixing unit 7 as described above. In this embodiment, the throughput is changed by changing the paper feed timing in response to the size of the recording sheet.

Figure 8:
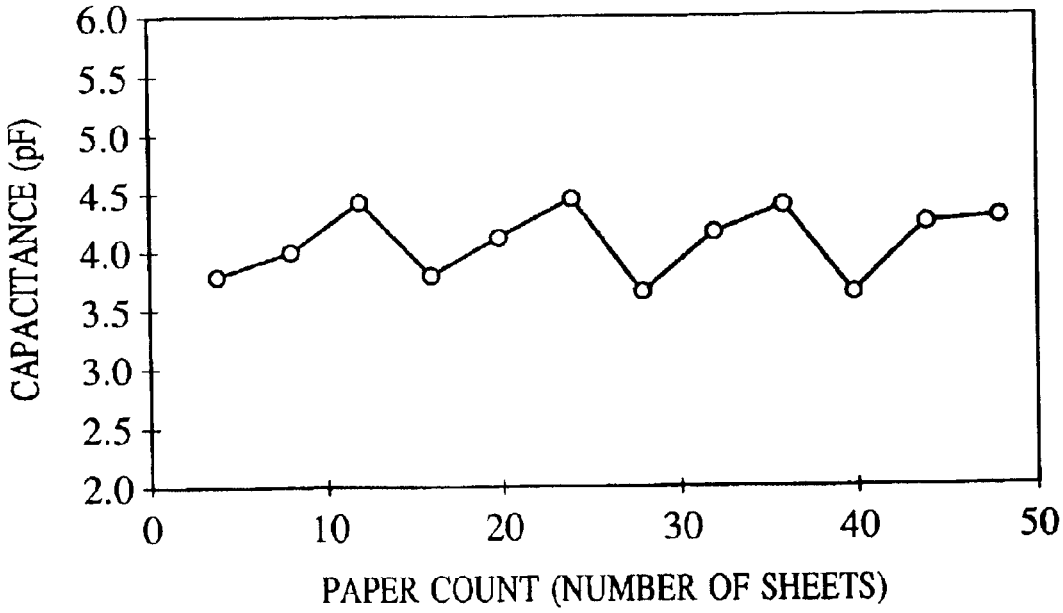
FIG. 8 is a graph illustrating measured data of the toner amount in the first embodiment.

A conventional case where the averaging method is not changed while changing the paper feed timing will now be considered. The measured data in this case are illustrated in FIG. 8. As shown in FIG. 8, when changing the paper feed timing, if averaging is applied in the above-mentioned sequence, i.e., in a sequence in which averaging is applied after acquiring four data points, averaging is not successful, and it is impossible to eliminate swells.

As described above, incorporation of a sequence delaying the paper feed timing does not result in an accurate detection of the remaining amount.

In this embodiment, therefore, the averaging method is changed in response to the paper feed timing.

Figure 9:
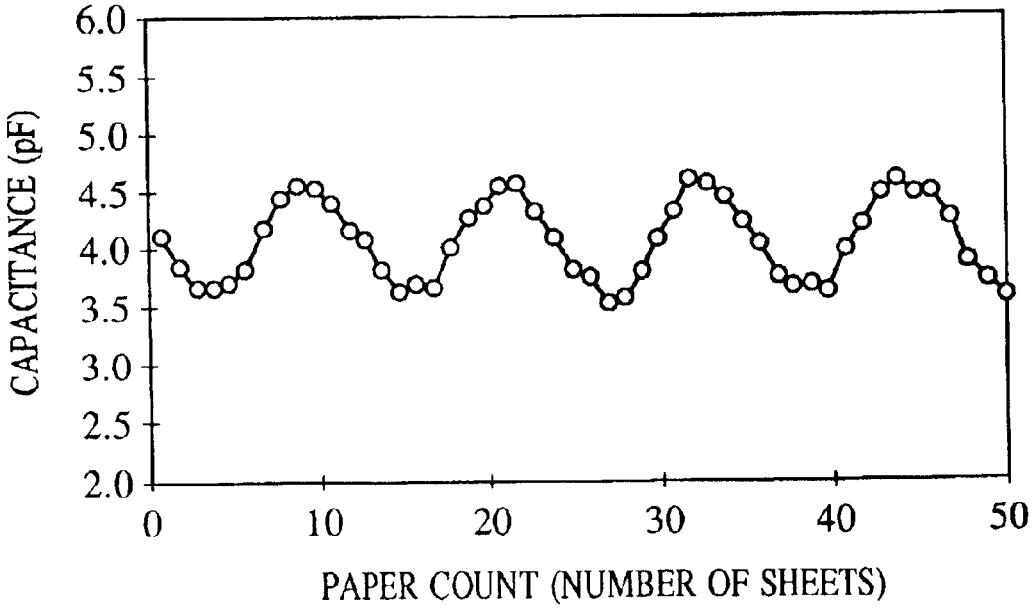
FIG. 9 is a graph illustrating measured data of the toner amount in the first embodiment.
Figure 10:
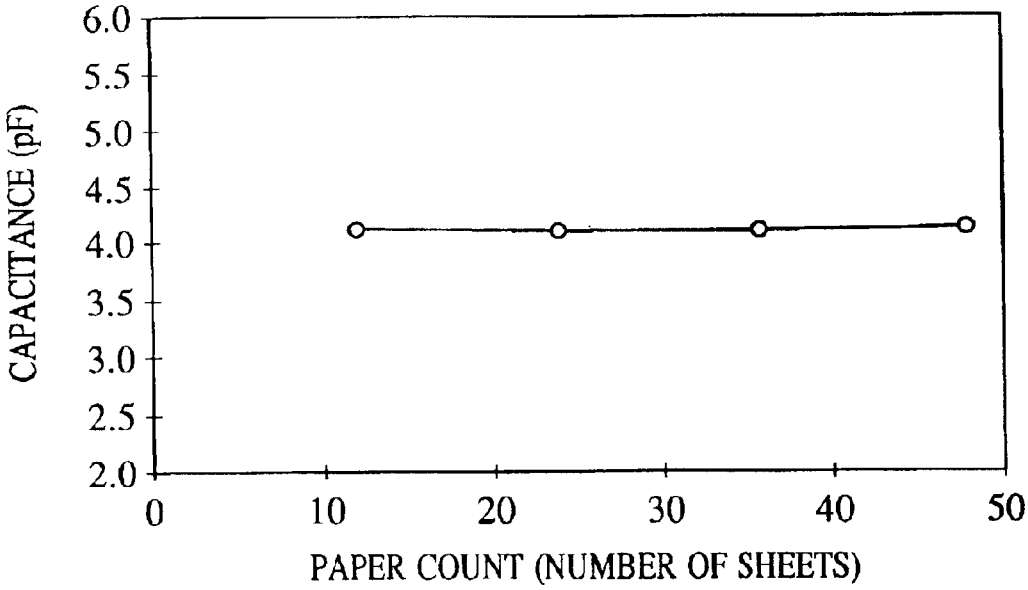
FIG. 10 is a graph illustrating measured data of the toner amount in the first embodiment.

A case where the paper feed timing is delayed by two seconds will be considered as in the above-mentioned case. Progress of the measured data before application of averaging in the case where the paper feed timing is delayed by two seconds is as shown in FIG. 9. As is clear from FIG. 9, in this case, there is a swell upon every feeding of 12 sheets, i.e., upon every acquisition of 12 data points. In this embodiment, therefore, in the case where the paper feed timing is delayed by two seconds, averaging is performed upon every acquisition of 12 data points. As a result, as shown in FIG. 10, swells are almost completely eliminated.

Cases other than a delay in paper feed timing of two seconds will not be considered. For example, when feeding a recording sheet having a very small width, such as an envelope, the paper feed timing is further delayed by about five seconds, as compared with the case of an A5 or B5-sized recording sheet P.

Figure 11:
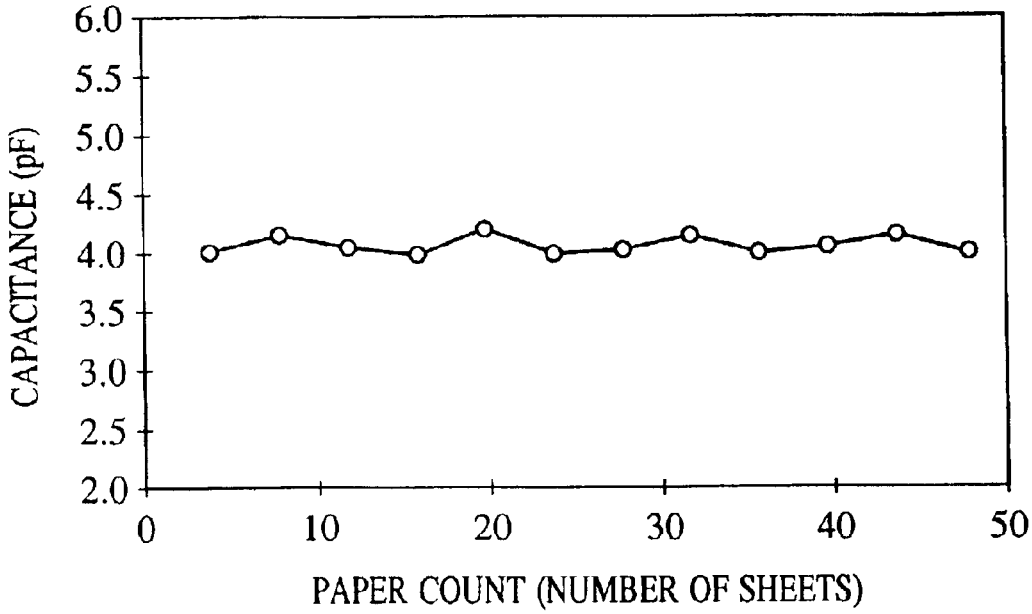
FIG. 11 is a graph illustrating measured data of the toner amount in the first embodiment.

When the paper feed timing is delayed by five seconds, application of averaging in a sequence without a change in the paper feed timing as in the conventional case, i.e., upon every acquisition of four data points leads to a progress of data points as shown in FIG. 11. In this case, although the extent of swells is slighter than in the case where the paper feed timing is delayed by two seconds, averaging does not function in an optimum manner and occurrence of swells is observed.

Figure 12:
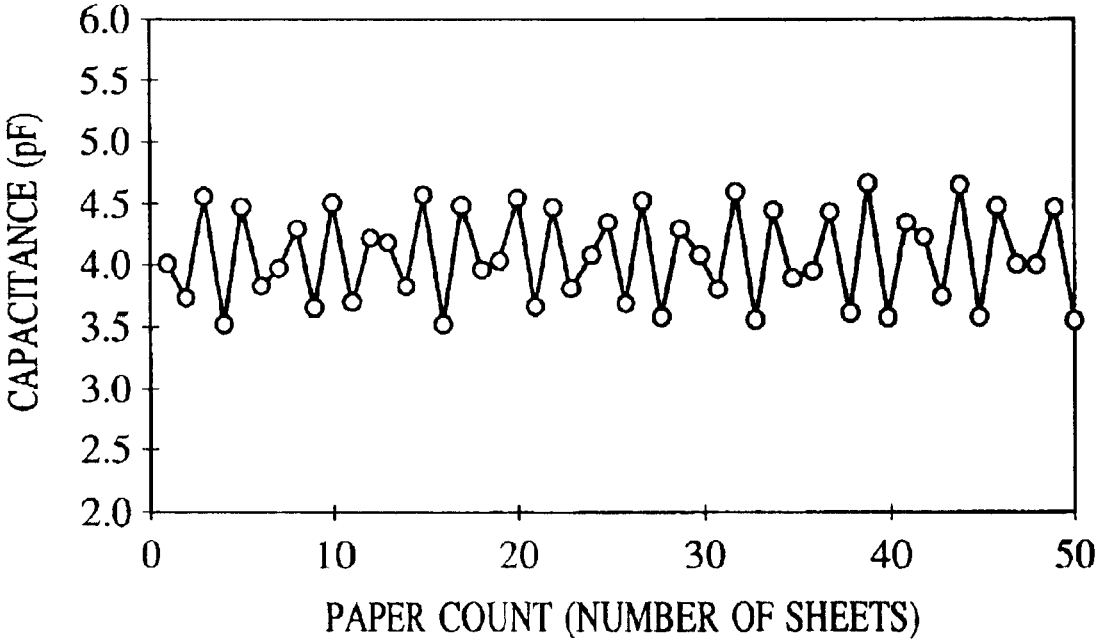
FIG. 12 is a graph illustrating measured data of the toner amount in the first embodiment.
Figure 13:
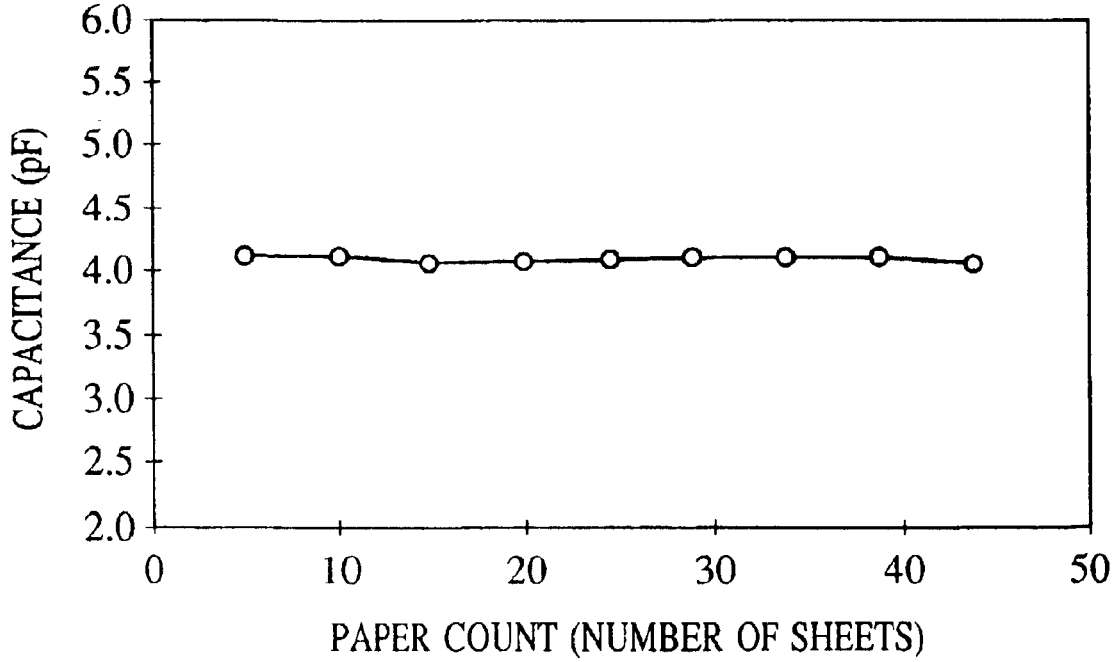
FIG. 13 is a graph illustrating measured data of the toner amount in the first embodiment.

The progress of measured data prior to averaging in the case where the paper feed timing is delayed by five seconds is as shown in FIG. 12. As is evident from FIG. 12, a delay in the paper feed timing by five seconds corresponds to occurrence of swells upon every feeding of five sheets, i.e., upon every acquisition of five data points. In this embodiment, therefore, in the case where the paper feed timing is delayed by five seconds, averaging is applied upon every acquisition of five data points. As a result, as shown in FIG. 13, swells are almost completely eliminated.

In view of the above-mentioned result, an example of the averaging method change sequence in the image forming apparatus 100 of this embodiment will now be described further with reference to FIG. 5.

First, when a print instruction is transmitted to the printer and a printing operation is started, the size of the recording sheet P subjected to printing is confirmed (Step 1). A time extension for paper feeding and a number of data points necessary for averaging are determined from the kind of the recording sheet P (Step 2). Printing is performed thereafter, and averaging is conducted in response to the number of averaging data points determined from the kind of paper, to detect the developer remaining amount level (Step 3), and an appropriate developer remaining amount level value is provided to the user (Step 4).

By performing control of the developer remaining amount level detecting operation in accordance with the above-mentioned sequence, it is possible to detect a developer remaining amount level detection at a high accuracy, and to provide the user with useful information.

Figure 5:
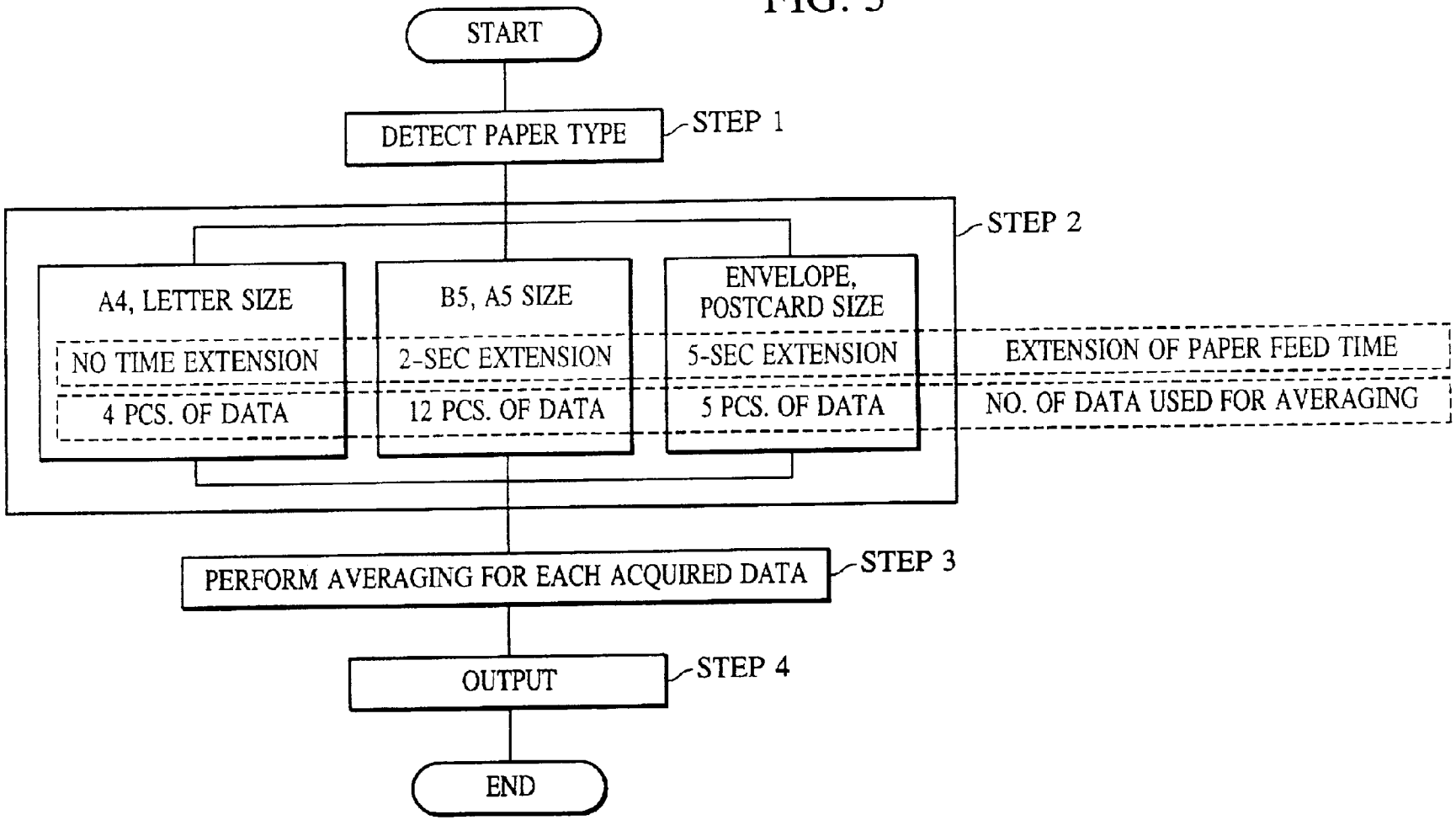
FIG. 5 is a flowchart for illustrating the averaging method changing sequence in a first embodiment of the present invention.

In this embodiment, the control in compliance with the sequence shown in FIG. 5, including determination of the size of recording sheet P and selection of a delay time of the paper feed timing, is accomplished by the arithmetic control circuit 38, which functions as control means and supervises and controls the image forming operation.

The effects of the present invention are not limited within the range described in this embodiment. For example, there are many prescribed periods of time necessary for averaging (time, acquired data) in response to a stirring period of the toner stirring unit or a delay time of the paper feed timing. The bias value and other values described in this embodiment have been presented only as examples for explaining the present invention, and it should be noted that the invention is not limited to these values.

In this embodiment, only one measured data point of the amount of toner immediately before feeding the recording sheet P has been described above as being acquired for an operation. The present invention is not limited to one data point, but may have a configuration in which more measured data points are acquired immediately prior to feeding the recording sheet P. The timing of acquisition is not limited to immediately before feeding of the recording sheet P, but similar advantages are available even immediately after the end of paper feeding, or during an interval between two recording sheets P when recording sheets are continuously fed. Measurement made before and after paper feeding ensures a higher accuracy.

In this embodiment, averaging of measured data points of the amount of toner is changed by changing the number of data points for averaging (averaging time). The present invention is not however limited to this. For example, in a configuration in which a plurality of data points are acquired immediately before paper feeding of the recording sheet P, and averaging is applied upon feeding of a sheet, similar advantages are available also by changing the number of measured data points during sampling (period) so as to increase the number of acquired data points upon feeding one sheet in response to the throughput.

In this embodiment, furthermore, the measured data of the amount of toner has been described with the capacitance with reference to FIGS. 6 to 13. It is, however, needless to mention that the form of measured data may be changed to a form of information favorable for configuring circuits by connecting this capacitance into the voltage value or the like.

According to this embodiment, as described above, it is possible to accurately detect the developer remaining amount level without fail.

Second Embodiment

Another embodiment of the present invention will now be described. Because the basic configuration and operations of the image forming apparatus of this embodiment are the same as in the first embodiment, the components having the same functions and configuration are assigned the same reference numerals, and the detailed description thereof is omitted here.

In the first embodiment, upon changing the throughput through a change in the paper feed timing, the embodiment has been described in which high-accuracy detection of the developer remaining amount level is made possible by changing the method of averaging by changing the number of samples taken and the number of data points to be averaged.

In this embodiment, a case where the throughput is changed by changing the drive itself (changing the rotating speed of the driving unit) will be described. In this case also, as described later, high-accuracy detection of the developer remaining amount level is made possible by changing the averaging method in accordance with this embodiment.

Changing the drive can be accomplished by changing the speed of a driving unit (such as a motor) driving the photosensitive drum 1 or the conveying roller, such as a resist roller 13, for conveying the recording sheet.

The meaning of changing the drive (paper feeding speed) will be described here. There is a constant demand for improving the paper feeding speed. However, it is difficult to simultaneously achieve a higher image quality. Increasing the conveying speed inevitably leads to a decrease in the period of time required for developing, the time for transfer, or the time for fixing. In addition, an air flow may be produced in the conveying path during conveyance of the recording sheet P. This air flow affects the not-as-yet fixed toner image transferred onto the recording sheet P, and this may cause splashing. Causes of a lower image quality are actually inseparable from the achievement of a higher paper feeding speed.

As a counter-measure against this inconvenience, there is often provided a mode for obtaining a high-resolution image quality by decreasing the speed of the driving unit itself, to reduce the throughput, and to extend the time during which development can be performed.

The image forming apparatus of this embodiment has a mode for obtaining such a high resolution. In this embodiment, therefore, a decrease in the speed of the driving unit itself in the mode for achieving a high resolution is utilized, and the number of data points upon sampling of measured data by the detector circuit 36 is changed in response to the driving speed of the driving unit. Improvement of the accuracy of detection of the developer remaining amount level is thus attempted.

The term "a driving unit" as used herein means driving means 22 (motor) of the photosensitive drum 1, driving means 23 (motor) of the transfer roller 5, or other driving means (motor) of the conveying system of the recording sheet P. In the image forming apparatus 100 of this embodiment, in a state in which the process cartridge B is mounted on the apparatus main body A, the drive transmitted from the driving means 22 to the photosensitive drum 1 is transmitted to the developing roller 43 via a gear mechanism. The drive transmitted to the developing roller 43 is in turn transmitted to the first and second stirring members 45 and 46 via the gear mechanism or the like.

At a reduced driving speed (revolutions) of the driving unit itself, it becomes possible to obtain many measuring data points in a run of sampling. When the revolutions of the driving unit are reduced by half, twice as long a period for sample is ensured.

For example, a case where measured data points of the amount of toner are sampled immediately before paper feeding of the recording sheet P is considered as in the first embodiment. With a very small number of measured data points of about one data point per run of sampling (period), the measured data points of the amount of toner are seriously affected by swells of the toner caused by the first stirring member 45. As a result, the individual measured data points have large ranges of error, and it is difficult to obtain an accurate result of detection of the developer remaining amount level.

When a plurality of data points are obtained by changing (reducing) the revolutions of the driving unit, on the other hand, measured data points in a single run of sampling are averaged, and the result is used as a measured data point upon feeding a single sheet. In addition, measured data points obtained in a run of sampling are averaged, and the resultant data points are further averaged for a few runs of sampling in response to the stirring period. As a result, it is possible to reduce the error ranges for the individual measured data points, and to conduct accurate detection of the remaining amount.

Figure 14:
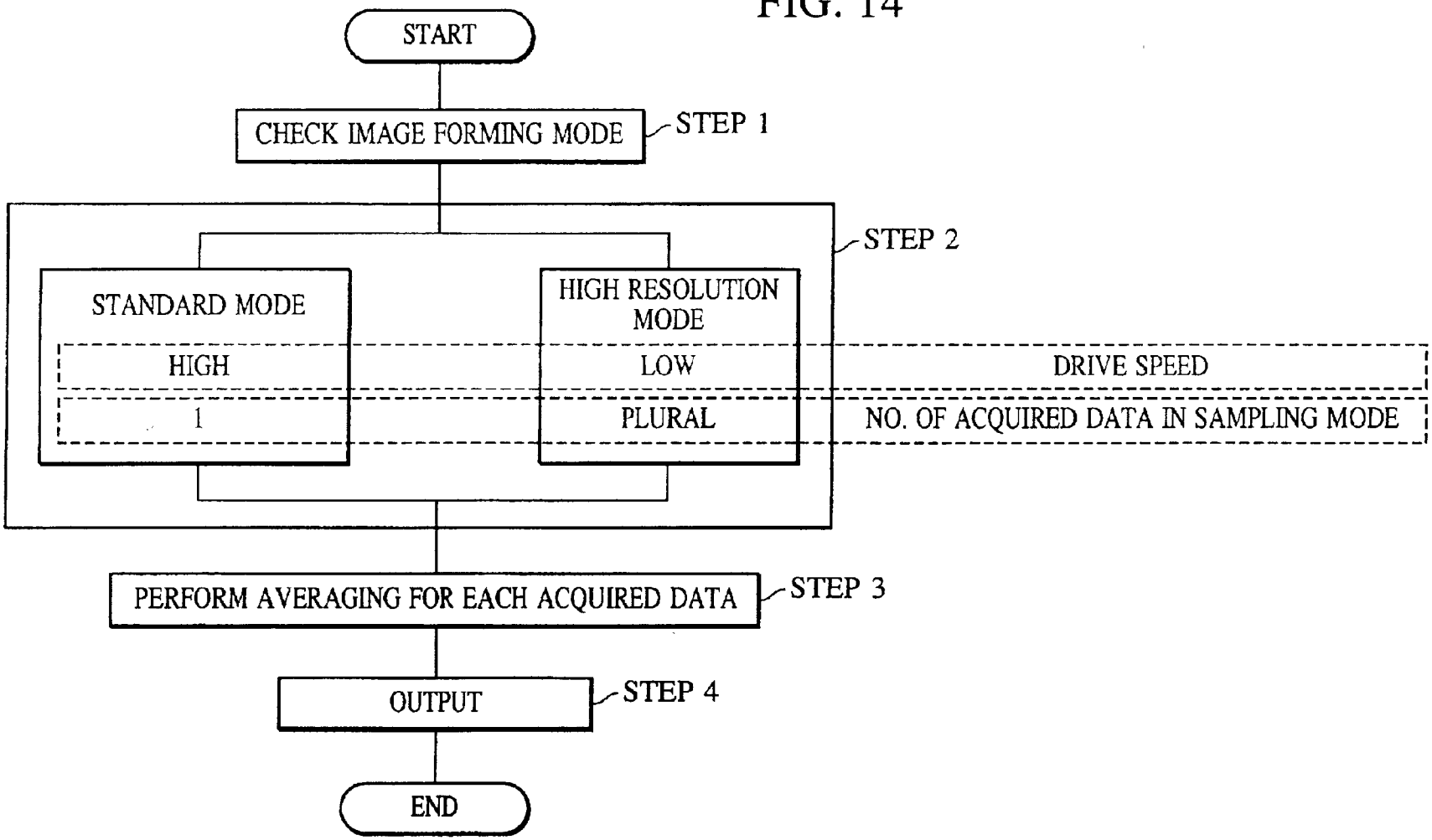
FIG. 14 is a flowchart for illustrating a averaging method changing sequence in an second embodiment of the present invention.

The averaging change sequence of this embodiment is illustrated in FIG. 14. When a print instruction is transmitted to the printer, and the printing operation is started, it is determined whether the image forming mode is the usual mode or the high-resolution image mode (Step 1). A driving speed of the driving unit and the number of measured data points acquired upon sampling are determined (Step 2). Then, the printing operation is carried out, and an averaging processing determined by the image forming mode is performed to detect a developer remaining level (Step 3). Then, an appropriate developer remaining amount level value is provided to the user (Step 4).

In this embodiment, control in conformity to the sequence shown in FIG. 14, including configuration of the image forming mode and selection of a number of measured data points upon sampling, is accomplished by the arithmetic control circuit 38, which functions as control means and governs and controls the image forming operations.

In addition to changing the averaging method of measured data points of the amount of toner in the case where the drive of the driving unit itself is changed, as described in this embodiment, further improvement of accuracy can be achieved by incorporating a change in the averaging method in a case where the paper feed timing is changed, as described in the first embodiment.

The present invention is not limited to conditions of this embodiment. For example, there is no limitation in details of the statistical processing, or in the number of sampled data points. In this embodiment, the description has been based on the acquisition of measured data points of the amount of toner immediately before feeding the recording sheet P. The present invention is not however limited to this, as in the first embodiment.

As described above, it is possible to eliminate dispersion of measured data points of the toner amount caused along with the tendency toward a higher speed, and achieve a higher-accuracy detection of the developer remaining amount level by changing the averaging method of measured data when the throughput is changed in accordance with the throughput changing sequence provided for achieving a higher image quality and a higher durability.

In the aforementioned embodiments, the bias for measuring the amount of toner is impressed onto the first electrode 51. The bias for measuring the amount of toner may be impressed onto the second electrode 52 in place of the first electrode 51.

In the aforementioned embodiments, the developing bias impressing means and the developer remaining amount level detecting bias impressing means are separately provided. Apart from this, a bias may be impressed onto both the developing roller and the plate antenna by switching over from time to time, for example, from the developing bias impressing means.

In the aforementioned embodiments, the present invention has been described with reference to the image forming apparatus having a detachable process cartridge B. The present invention is however applicable also to an image forming apparatus having a developing cartridge detachable from the apparatus main body A, comprising a developing unit 4 having a toner container 41 and a developing container 42, to an image forming apparatus having a toner container 41 individually detachable from the apparatus main body A, and an image forming apparatus having a toner container 41 which is not of the detachable cartridge type but is fixed to the apparatus main body A, with the same advantages as above.

Third Embodiment

Another embodiment of the present invention will now be described. Basic configuration and operation of the image forming apparatus of this embodiment are the same as in the first embodiment. Components having the same functions and configurations are therefore assigned the same reference numerals, and a detailed description thereof is omitted here.

In the second embodiment, an embodiment in which, when changing the throughput by changing the rotating speed of the driving unit, particularly when reducing the throughput, achievement of a high accuracy of detection of the developer remaining amount level is permitted by changing the number of sampled data points and the number of averaged data points has been described. This embodiment describes a case where, when changing the throughput by changing the rotating speed of the driving unit, a higher accuracy of detection of the developer remaining amount level can be achieved by changing the sampling interval (sampling period) in response to a plurality of throughput values.

The differences between the above-mentioned second embodiment and the third embodiment will be described. In the second embodiment, the pre-rotation of the stirring unit immediately before paper feeding or rotation between sheets is smaller than a period, and averaging is applied after feeding a certain number of sheets. In this embodiment, revolutions of the stirring unit are adjusted so that the stirring unit can rotate for a full period in pre-rotation immediately before paper feeding or rotation between sheets. In this embodiment, the configuration has two throughput modes including a normal mode, having revolutions of the driving unit of 30 ppm, and a high-resolution mode, having revolutions of 15 ppm. In this configuration, the toner stirring unit makes a turn for a full period even between recording sheets during continuous paper feeding. In this embodiment, the normal mode with 30 ppm corresponds to an interval between sheets of 0.5 seconds. A stirring rotating speed is therefore set as 120 rpm. Ten toner remaining amount detection data points are required at intervals of 50 msec during a period of 0.5 seconds immediately before paper feeding. The ten data points are averaged, and toner remaining amount detection is carried out by using averaged data.

Figure 15:
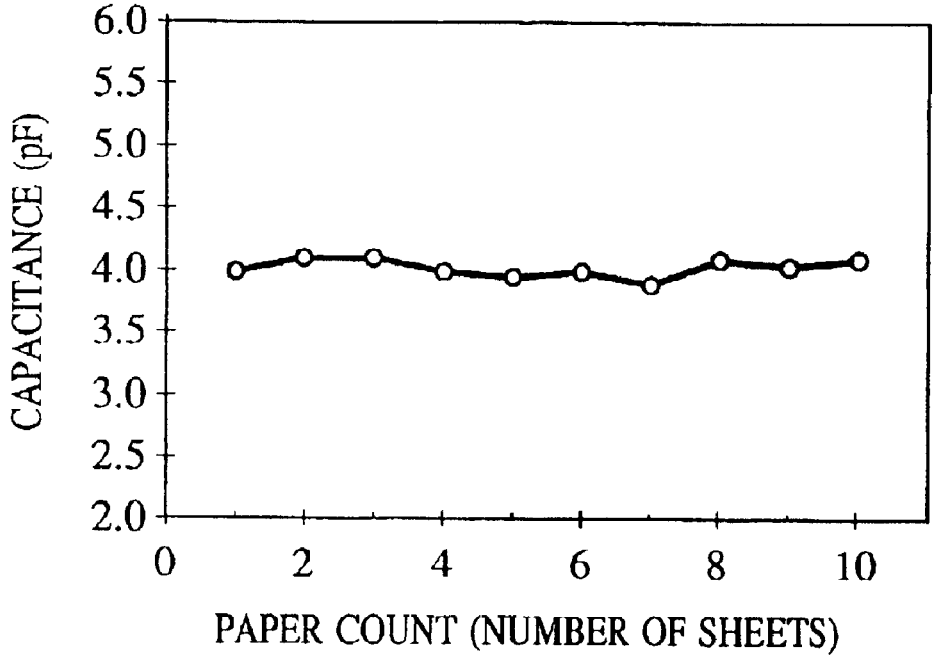
FIG. 15 is a graph illustrating measured data of the toner amount in a third embodiment.
Figure 16:
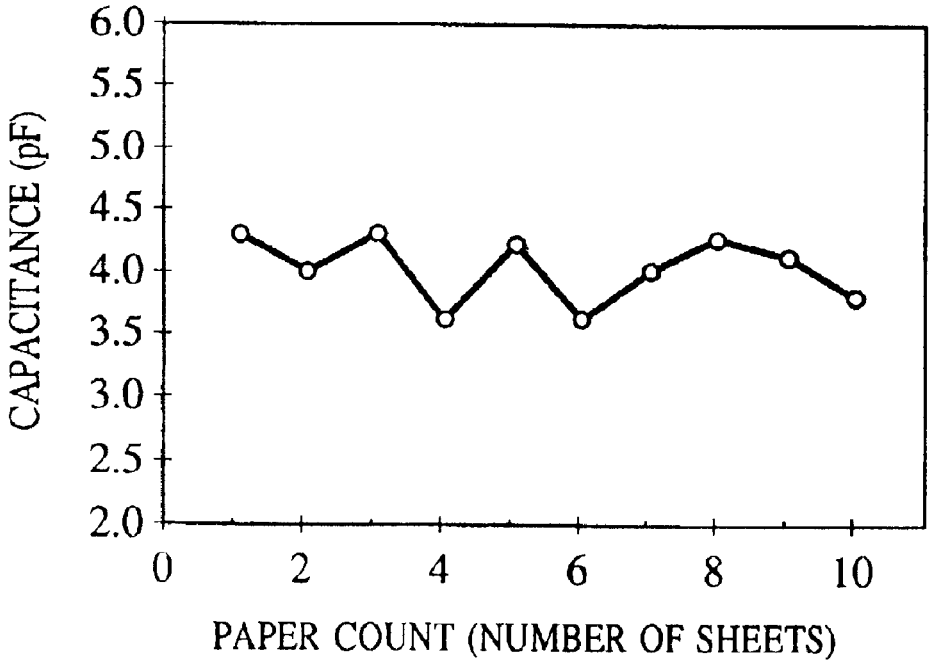
FIG. 16 is a graph illustrating measured data of the toner amount in the third embodiment.

In a case where continuous paper feeding is performed using the configuration of this embodiment, the progress of toner remaining amount detection data acquired between recording sheets is illustrated in FIG. 15. FIG. 15 suggests that the averaged data points acquired between recording sheets exhibit a certain progress. The progress of toner remaining amount detection data points is therefore confirmed also for the case of 15 ppm in the high-resolution mode. The conditions including the sampling period and averaging are the same as in the case of 30 ppm. As shown in FIG. 16, when changing the throughput to 15 ppm, the data points show an unstable progress. This is attributable to the fact that the decrease in the rotating speed of the stirring unit in response to the throughput makes it impossible to remove swells during the stirring period through an averaging processing in the same averaging method as that of 30 ppm.

Figure 17:
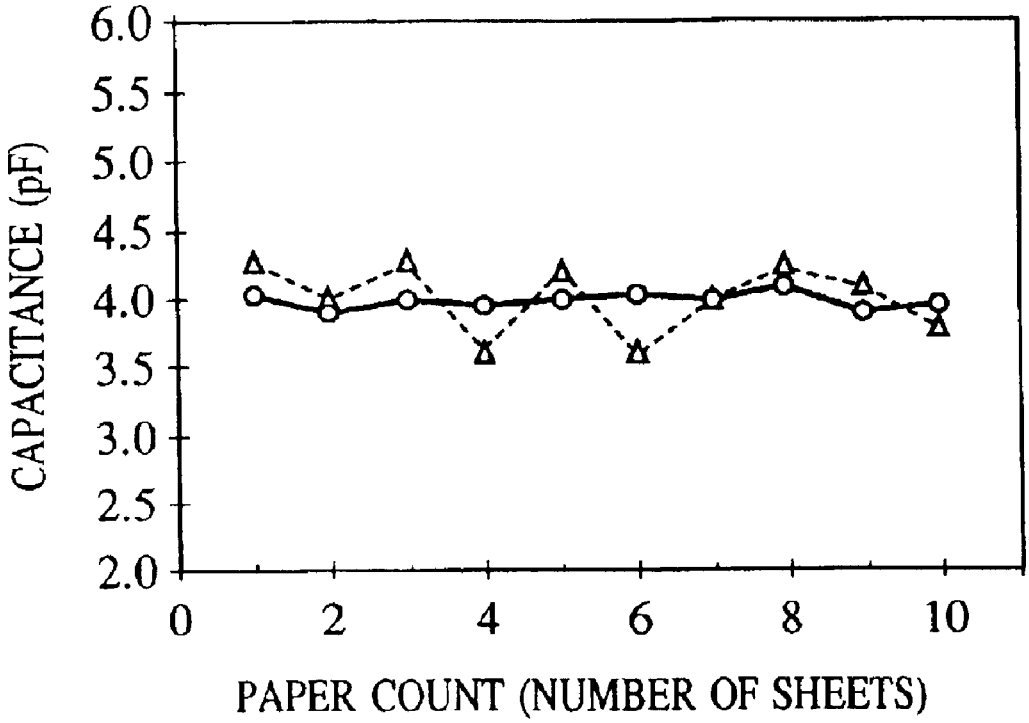
FIG. 17 is a graph illustrating measured data of the toner amount in the third embodiment.

Therefore, when the throughput becomes half, that of 15 ppm, the sampling period is changed to twice as long, every 100 msec, in view of the rotation period of the stirring unit. The number of data points used for averaging is always 10. The result is as shown in FIG. 17; as compared with the case where the same sampling method is kept not in response to the process speed shown in FIG. 16, the change in the sampling period in response to the process speed permits obtaining constant toner remaining amount detection data.

Figure 18:
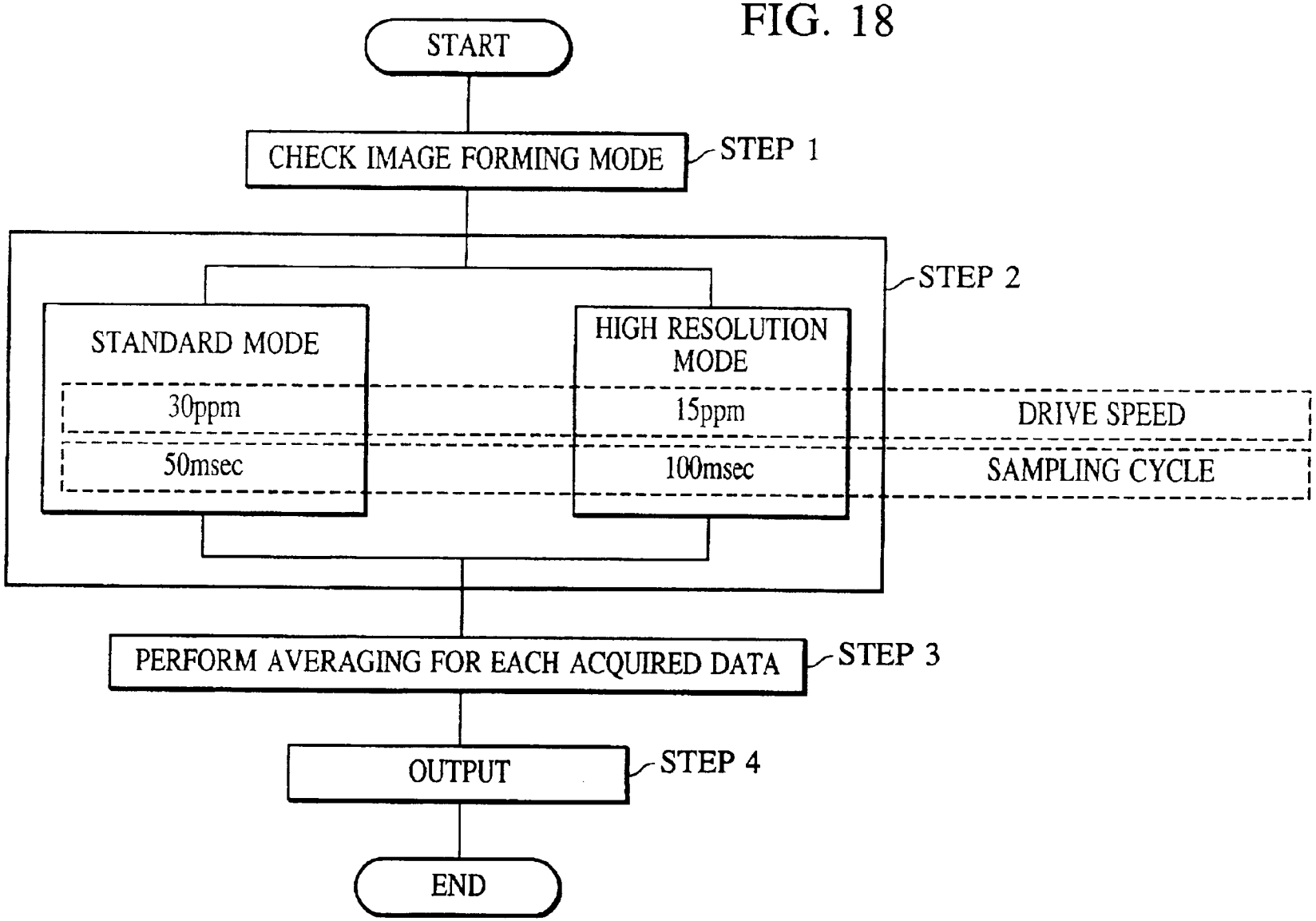
FIG. 18 is a flowchart for illustrating the averaging method changing sequence in the third embodiment of the present invention.

The averaging method changing sequence of this embodiment is illustrated in FIG. 18. When a print instruction is transmitted to the printer, and the printing operation is started, it is confirmed whether the image forming mode is the normal mode or the high-resolution image mode (Step 1). From the image forming mode, a driving speed of the driving unit and the sampling period for acquiring data upon sampling are determined (Step 2). Thereafter, the printing operation is performed, and a developer remaining amount level is detected by applying an averaging processing specified by the image forming mode (Step 3). An appropriate developer remaining amount level value is provided to the user (Step 4).

In this embodiment, control operations carried out in accordance with the sequence of FIG. 18, such as confirmation of the image forming mode and selection of the number of measured data upon sampling, are conducted by the arithmetic control circuit 38, which functions as control means for supervising and controlling the image forming operation.

As described above regarding this embodiment, it is possible to obtain constant toner remaining amount detection data, not depending upon revolutions of the driving unit by changing revolutions of the driving unit, and changing the sampling period in response thereto.

In this embodiment, a configuration with two process speeds has been described. The invention is not however limited to this. When presence of a plurality of process speeds provides useful effects, high-accuracy toner remaining amount detection is possible by providing gradual process speeds, and setting sampling periods corresponding thereto.

For the measurement timing in this embodiment, a method for acquiring data within a shortest period of time immediately before paper feeding or between recording sheets has been described. The invention is not however limited to this, but a method of acquiring toner remaining amount detection data during paper feeding onto which a developing bias has been impressed is valid for obtaining advantages of this sequence.

Successive detection of the developer remaining amount does not mean, on the assumption of an initial amount of filling of the developer in the developer container of 100% and absence of the developer expressed as 0%, only that the developer remaining amount level is detected for all areas from 100% through 0%. For example, the developer remaining amount may be detected within the region of 50% to 0%. Absence of developer (0%) does not mean exclusively the complete exhaustion of the developer, but includes a state in which the remaining amount of developer decreases to a level not permitting formation of an image of an appropriate quality, even if a slight amount of developer remains.

According to the present invention, as described above, in an image forming apparatus having a plurality of throughput modes, the averaging method of measured data of the developer remaining amount by the developer remaining amount detecting member is changed in response to the throughput. It is therefore possible to successively detect the remaining amount of developer at a high accuracy in response to the throughput.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus capable of forming an image at any of a plurality of printing speeds, comprising:

a developer container containing a developer;

a developer amount detecting member which detects a developer remaining amount in said developer container and outputs a detection value; and a control section which determines a developer remaining amount by subjecting a plurality of detection values from said developer amount detecting member to an arithmetic processing, wherein said control section changes the arithmetic processing in response to the printing speed.

2. An image forming apparatus according to claim 1, further comprising:

a paper feed section which feeds a recording medium on which an image is to be formed, wherein said control section changes the printing speed by changing a driving timing of said paper feed section.

3. An image forming apparatus according to claim 2, wherein the driving timing of said paper feed section is changed in response to a kind of the recording medium.

4. An image forming apparatus according to claim 1, wherein the arithmetic processing is an averaging processing of the plurality of detection values.

5. An image forming apparatus according to claim 1, wherein said developer amount detecting member has a pair of opposing electrodes, and successively outputs detection values in response to a developer amount in said developer container by applying a bias to one of said opposing electrodes.

6. An image forming apparatus according to claim 1, further having a plurality of said developer amount detecting members.

7. An image forming apparatus according to claim 1, wherein at least said developer container and said developer amount detecting member are integrally formed into a cartridge which is attachable to and detachable from a main body of said image forming apparatus.

8. An image forming apparatus capable of forming an image at any of a plurality of printing speeds, comprising:

a developer container containing a developer;

a developer amount detecting member which detects a developer remaining amount in said developer container and outputs a detection value;

a conveying section which conveys a recording medium on which an image is to be formed; and a control section which determines a remaining amount of developer by arithmetically processing a detection value output from said developer amount detecting member for each run of conveyance of the recording medium to said conveying section, wherein said control section changes a detecting period of the detection value from said developer amount detecting member for each run of conveyance of the recording medium to said conveying section, in response to the printing speed.

9. An image forming apparatus according to claim 8, further comprising:

a driving section which drives said conveying section, wherein said control section changes the printing speed by changing a driving speed of said driving section.

10. An image forming apparatus according to claim 8, wherein the printing speed is changed in response to an image forming mode of said image forming apparatus.

11. An image forming apparatus according to claim 8, wherein said developer amount detecting member has a pair of opposing electrodes, and successively outputs detection values in response to a developer amount in said developer container upon application of a bias to one of said opposing electrodes.

12. An image forming apparatus according to claim 8, further having a plurality of said developer amount detecting members.

13. An image forming apparatus according to claim 8, wherein at least said developer container and said developer amount detecting member are integrally formed into a cartridge which is attachable to and detachable from a main body of said image forming apparatus.

14. A controlling method of an image forming apparatus capable of forming an image at any of a plurality of printing speeds, the image forming apparatus including a developer container containing a developer; a developer amount detecting member which detects a developer remaining amount in the developer container and outputs a detection value; and a control section which determines a developer remaining amount by subjecting a plurality of detection values from the developer amount detecting member to an arithmetic processing; said controlling method comprising:

a first step of detecting a kind of a recording medium on which an image is to be formed;

a second step of determining a printing speed in response to the kind of the recording medium detected in said first step; and a third step of determining the remaining amount of developer by changing the arithmetic processing in response to the printing speed determined in said second step.

15. A controlling method of an image forming apparatus capable of forming an image at any of a plurality of printing speeds, the image forming apparatus including a developer container containing a developer; a developer amount detecting member which detects a developer remaining amount in the developer container and outputs a detection value; a conveying section for conveying a recording medium on which an image is to be formed; and a control section which detects a remaining amount of developer by arithmetically processing a detection value output from the developer amount detecting member for each run of conveyance of a recording medium to the conveying section; said controlling method comprising:

a first step of determining a printing speed in response to an image forming mode of the image forming apparatus;

a second step of changing a detection period of a detection value from the developer amount detecting member in every run of conveyance of a recording medium to the conveying section in response to the image forming mode determined in said first step; and a third step of determining a remaining amount of developer using a detection value detected in said second step.

* * * * *

UNITED STATES PATENT AND TRADEMARK OFFICE

CERTIFICATE OF CORRECTION

PATENT NO. : 6,785,479 B2
DATED : August 31, 2004
INVENTOR(S) : Norihito Naito et al.

It is certified that error appears in the above-identified patent and that said Letters Patent is hereby corrected as shown below:

Column 6,
Line 4, “an” should read -- a --.
Line 7, “a” should read -- the --.

Signed and Sealed this

Seventeenth Day of May, 2005

JON W. DUDAS
*Director of the United States Patent and Trademark Office*